US007756442B2

(12) United States Patent
Keefe et al.

(10) Patent No.: US 7,756,442 B2
(45) Date of Patent: Jul. 13, 2010

(54) LOCKING FEATURE FOR USE IN CARTRIDGE INSERTION GUIDE APPLICATIONS

(75) Inventors: David L. Keefe, Cato, NY (US); Karl E. Kurz, Rochester, NY (US); Mark T. Bartlett, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 968 days.

(21) Appl. No.: 11/522,755

(22) Filed: Sep. 18, 2006

(65) Prior Publication Data

US 2008/0069587 A1 Mar. 20, 2008

(51) Int. Cl.
*G03G 21/18* (2006.01)

(52) U.S. Cl. ..... 399/115; 399/168; 399/170; 399/172

(58) Field of Classification Search ..... 399/100, 399/110, 115, 168, 170, 172
See application file for complete search history.

(56) References Cited

U.S. PATENT DOCUMENTS 2,297,691 A 10/1942 Carlson
4,914,480 A * 4/1990 Endo ..... 399/172
5,485,253 A * 1/1996 Osbourne ..... 399/170
6,735,407 B2 * 5/2004 Chavez et al. ..... 399/170
7,295,793 B2 * 11/2007 Palmer et al. ..... 399/115

FOREIGN PATENT DOCUMENTS

JP 58193560 A * 11/1983
JP 2003122092 A * 4/2003

* cited by examiner

*Primary Examiner*—David M Gray
*Assistant Examiner*—Geoffrey T Evans
(74) *Attorney, Agent, or Firm*—James J. Ralabate

(57) ABSTRACT

A guide is used to protect a corona cartridge during shipping and during insertion into an electrostatic marking apparatus. The guide has dimensions that will permit the cartridge to fit therein and has a locking mechanism that securely holds the cartridge in place during shipment or movement. When the cartridge is to be removed from the guide and inserted into an electrostatic marking system, a handle attached to a latch is used to free the latch from a groove in the guide. The groove in the guide is located between two upwardly protruding ramps having a slidable side and a locking side that abuts the latch and holds it in place until activation when the latch handle frees it from the groove.

15 Claims, 3 Drawing Sheets

LOCKING FEATURE FOR USE IN CARTRIDGE INSERTION GUIDE APPLICATIONS

CROSS REFERENCES TO RELATED APPLICATIONS

The present embodiments relate to corona charging in an electrostatic marking process and, more specifically, to a guide apparatus and system for replacing corona assemblies.

BACKGROUND

Electrostatography is best exemplified by the process of xerography as first described in U.S. Pat. No. 2,297,691 to C. F. Carlson. In this process, the photoconductor is first provided with a uniform electrostatic charge over its surface and is then exposed to image wise activating electromagnetic radiation which selectively dissipates the charge in illuminated areas of the photoconductor while the charge in the non-illuminated areas is retained thereby forming a latent electrostatic image. This latent electrostatic image is then developed or made visible by the deposition of finely-divided electroscopic marking particles referred to in the art as "toner". The toner will normally be attracted to those areas of the layer which retain a charge, thereby forming a toner image corresponding to the latent electrostatic image. This powder image may then be transferred to a support surface, such as paper. The transferred image may subsequently be permanently affixed to the support by heat fusing. Instead of forming a latent image by uniformly charging the photoconductive layer and then exposing the layer to a light and shadow image, a latent image may be formed by charging an insulating or photoconductive insulating member in image configuration. The powder image may be fixed to the imaging member if elimination of the powder image transfer step is desired.

Several methods are known for applying an electrostatic charge to the photosensitive member, such as the use of electron-emitting pins, an electron-emitting grid, single corona-charging structures, scorotrons and multiple dicorotron wire assemblies. In recent development of high speed xerographic reproduction machines where copiers can produce at a rate of up to or in excess of two to three thousand copies per hour, the need for several reliable corona charging assemblies in order to utilize the full capabilities of the reproduction system is required. Also, with the advent of color copiers where several corona-charging stations are needed, the requirement for dependable corona or scorotron assemblies for depositing an electrostatic charge is essential.

Generally, in electrostatographic or electrostatic copy processes, a number of corotrons, dicorotrons or scorotrons are used at various stations around the photoreceptor. For example, they are or may be used at the station that places a uniform charge on the photoreceptor at a transfer station, at a cleaning station, etc. In today's complex marking apparatus, it is important that all charging units (or corotrons) are in perfect working order since corotron malfunction or damage can easily render the entire electrostatic copying process non-functional. Maintaining each corotron unit in perfect working order from shipping to insertion in the machine is essential to the proper functioning of these complex marking systems or copiers.

In shipping, these corotron cartridges sometimes referred to as customer replacement units, the corotron or scorotron is housed in a protective guide, this guide is needed both to protect the corotron during shipping and to aid the customer in the insertion of the corotron cartridge into the electrophotographic marking apparatus. Some current protection guides have locking features or designs intended to retain the corona cartridges in place during shipping and insertion into the electrostatic marking apparatus. Since corona cartridges are comparatively expensive and require special care to avoid damage, attention to these protection guides is essential. While these prior art locking features generally will retain the cartridge under ideal conditions, if sufficient force is applied, or if the protection guide is turned on end, the cartridge will release from the guide and fall out. This is possible during shipping and during handling or while inserting the cartridge into the electrostatic marking machine. Once the cartridge falls free of the protective guide, there is great potential for damage.

SUMMARY

The present embodiments provide an improved protection guide for a corotron cartridge with a substantially more secure locking feature. This improvement allows the cartridge to slide into a special guide that protects the wires as the Customer Replacement Unit (CRU) is inserted into the electrostatic marking machine. The cartridge will not release until the latch handle is activated. The cartridge will not fall out if the protection guide is turned on end and will prevent the cartridge from falling out of the guide prematurely. Each cartridge has a release handle used to release the latch mechanism into the marking apparatus. This latch mechanism secures the cartridge within the guide until it is in the copier. The corotron cartridge is provided to the customer in a protection guide that is used to aid the customer in the insertion of the cartridge. This guide also helps to protect the cartridge during shipping and handling. With the locking feature provided herein, the cartridge will easily slide into the guide but not release until the latch handle is activated.

In embodiments of this invention, the Guide-CRU has two functions. The first function is to protect the charge corotron assembly during shipping and handling. The second function is to aid the customer in the loading of the charge corotron assembly (or CRU-Customer Replaceable Unit) into the machine.

A problem that was noted on the current design is that the CRU can release itself and fall out of the Guide when tipped vertically. This is a problem due to the sensitive nature of this charge device. The current design has two small walls that try to prevent the CRU from sliding out of the Guide but, due to the ramp-like support on the cover of the CRU, the CRU is able to jump right over these two prior art small walls.

To prevent the CRU from releasing on its own, the present invention provides a change to the prior art wall design to a "teeth-like" design. The two "teeth" or "ramps" are positioned in a manner that the latch fits between the two "teeth" not allowing the CRU to jump over. With this new design, the CRU cannot be released from the Guide until the customer squeezes the release on the corotron cartridge via the latch.

In one embodiment, the protection guide provided herein takes on an elongated, modified L-shaped form housing enabled to contain the entire corotron unit. At the bottom or floor of the housing are at least two upwardly protruding side-by-side triangular or pie wedge shape ramps having a groove there between. This structure permits a latch or protrusion which downwardly projects from the bottom of a corotron cartridge to fit into the groove and slide up the slanted or curved leg of the ramp to securely lock the cartridge in the groove between ramps or teeth of the protection guide. Since the latch now fits against the leg of the ramp, it will lock therein unless released by a latch handle that is operatively connected to the latch as shown in the figures accompanying this disclosure.

In a second embodiment of this invention above noted, a structure for the protection guide is used comprising a pie wedge shaped or quarter circular configuration with a straight side. In a third embodiment, the structure for the protection guide is to use any ramp structure shown in FIG. 6 below described. The essential features of embodiments involve (1) a ramp that is enabled to permit a latch to slide up and over one inclined or circular side and lock against an opposite side (to inclined or circular side) and (2) a groove (or grooves, if more than two ramps are used) that will have dimensions that will permit a latch to fit and lock therein. Any suitable latch locking structure as described and which prevents premature separation of the cartridge from the guide and can be released by the cartridge handle can be used alone or together with the above embodiments.

DETAILED DISCUSSION OF DRAWINGS AND PREFERRED EMBODIMENTS

Figure 1:
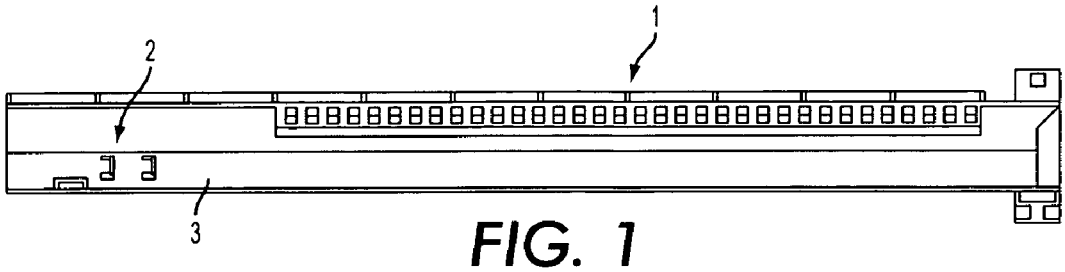
FIG. 1 PRIOR ART
FIG. 1 illustrates a top view of a prior art guide that could contain and house a conventional cartridge.

FIG. 1 illustrates from a top view a prior art protective guide 1 having notches 2 in the base or bottom portion 3 of the guide 1. The notches 2 are not sufficient to hold or retain the corotron cartridge 4 in place if a sufficient force is applied or if the guide 1 containing a cartridge 4 is turned on end.

Figure 2:
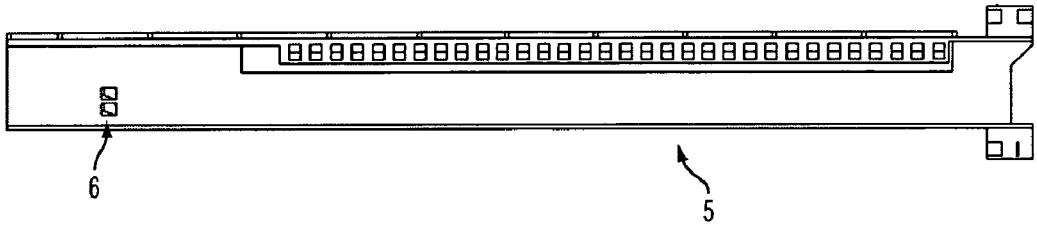
FIG. 2 illustrates a top view of an embodiment of the guide of the present invention.

In FIG. 2 a top view of an embodiment of the guide 5 of this invention is illustrated. The guide 5 has upwardly projecting ramps 6 having structures including those as shown in FIG. 6. When a latch 8 of a corotron cartridge 4 slides over the slanted or curved (slidable) side 9 of the ramps, it will lock against the opposite (or locking) sides 7 as shown in FIGS. 4 and 5.

Figure 3:
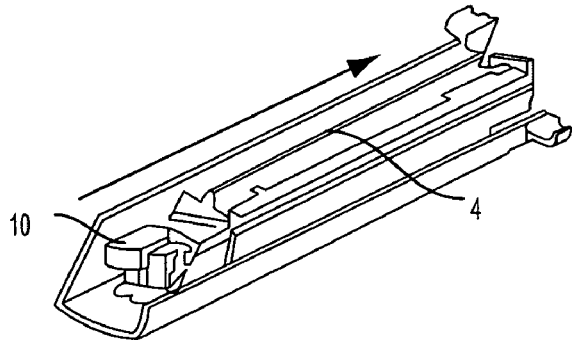
FIG. 3 illustrates a corotron cartridge in a guide of an embodiment of this invention.

In FIG. 3, a corotron cartridge 4 is shown in place housed in protective guide 5 in an embodiment of this invention. Cartridge 4 has a handle 10 that extends outwardly and releases latch 8 from groove 11 when the cartridge 4 is to be released from protective guide 5. As shown in FIG. 5, the cartridge 4 in guide 5 is packed this way and shipped thereby protecting the cartridge 5 from possible damage. Unless latch handle 10 is activated, the cartridge 4 is securely locked in place in groove 11 and in guide 5. Once the cartridge 4 is to be inserted into an electrostatic marking apparatus, the handle 10 is activated (pushed up) to release latch 8 from its locked position in a groove 11 between ramps 6.

Figure 4:
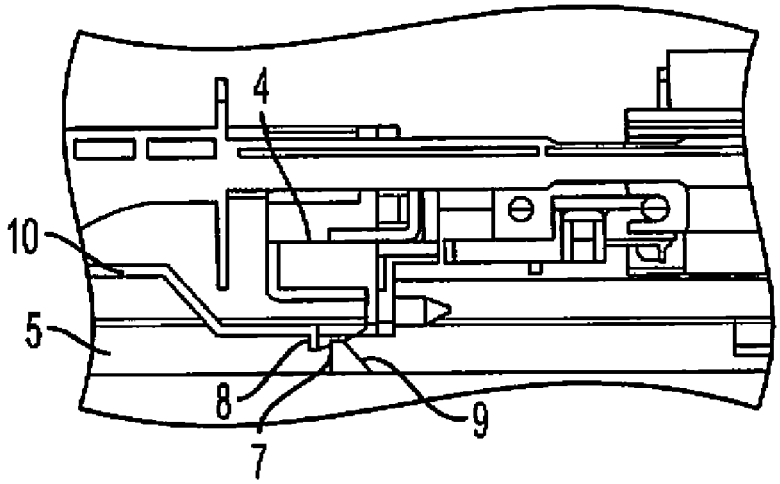
FIG. 4 illustrates a side plan view of a guide of an embodiment of this invention.
Figure 5:
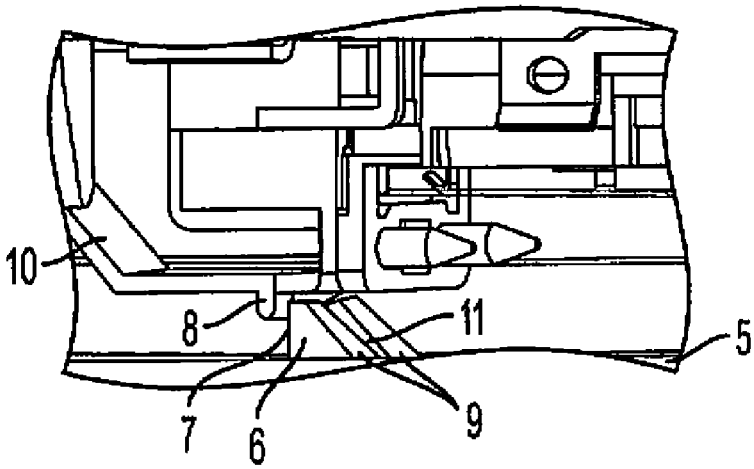
FIG. 5 illustrates a side perspective view of a guide of an embodiment of this invention.
Figure 6:
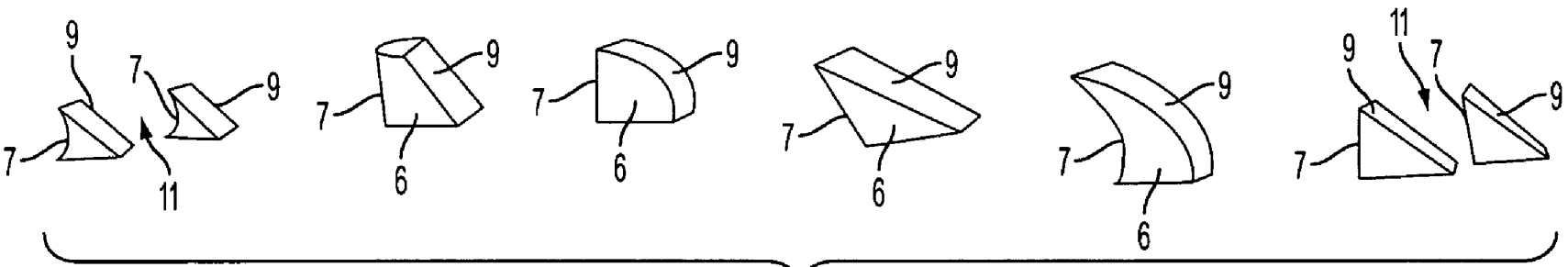
FIG. 6 illustrates various shaped ramps that may be used in embodiments of this invention.

In FIG. 4, a plan view of the cartridge 4 locked in guide 5 is shown and in FIG. 5 a perspective view of FIG. 4 is shown. Release handle 10 is spring-loaded holding latch 8 in a locking position as shown. Once latch handle 10 is lifted, latch 8 is lifted away from the grooves 11 and cartridge 4 is freed from guide 5 and is ready to be inserted into an electrostatic marking machine. Ramps 6 may have a triangular configuration with a straight side 7 or may be a quarter circular configuration with a straight side 7 or any other suitable ramp configuration as shown in FIG. 6. Some of these suitable ramp configurations are shown in FIG. 6. It is important that one side 7 of the ramps 6 have a locking side 7 so as to lock latch 8 of cartridge 4 in position and one ramp side 9 is a sliding side permitting the latch to slide into groove 11. Ramps 6 are positioned side by side in a spaced relationship to form a groove 11 there between. It is in groove 11 that latch 8 passes up and over a slidable side 9 to fall into and lock into groove 11. Any suitable number of ramps may be used.

In summary, embodiments of this invention comprise a Xerographic corona-generating cartridge protection guide comprising in an operative arrangement an elongated substantially modified L-shaped casing or housing and a corotron cartridge feature. This housing is enabled to house substantially the entire corotron or scorotron cartridge. The locking feature is positioned in the inner portion of a floor of the housing of the Guide. The locking feature comprises at least two upward protruding ramps or teeth having a slidable side and a groove between each of said teeth or ramps. The groove is adapted to mate with a latch projection on a lower portion of the corotron and the ramps and the groove is enabled to allow the latch and corotron to slide over the ramp and lock in place in the groove.

Also, in another embodiment of this invention, a corona package structure is used comprising in an operative arrangement a corona cartridge and a cartridge protection guide. The cartridge comprises at its lower portion a release latch and a release latch handle. The handle is enabled to move the latch when the handle is activated. The guide comprises a substantially modified L-shaped casing or housing and is enabled to house substantially the entire corona cartridge. A locking feature is positioned in an inner floor portion of the guide and comprises at least two upwardly protruding ramps which have a groove there between. The groove is adapted to mate with the latch and lock the latch and the cartridge in position. In one embodiment or structure, the ramp(s) have a configuration whereby one side of the ramp(s) is a straight side and the other is a slidable side. The ramp(s) have a configuration selected from the group consisting of a triangular ramp, a quarter circular ramp and a ramp with two curved sides, each of the ramps has a slidable side and a locking side. Also, the groove has dimensions suitable to allow the latch to fit therein. By "corona" as used herein includes all corona-generating devices such as corotrons, scorotrons etc.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A Xerographic corotron cartridge protection guide comprising in an operative arrangement an elongated substantially modified L-shaped casing or housing, and a corona-generating cartridge locking feature, said housing enabled to house substantially the entire corona cartridge, said locking feature positioned in an inner portion of a floor of said housing, said locking feature comprising at least two upward protruding ramps having a slidable side, a locking side and a groove between each of said ramps, said groove adapted to mate with a latch projection on a lower portion of said cartridge, said ramps and groove enabled to allow a latch and corotron to slide and lock in place, wherein said corotron slides and locks into place by moving in a substantially longitudinal direction of said housing.

2. The guide of claim 1 wherein said ramps are positioned to abut said latch when said corona-generating cartridge is enclosed in said guide.

3. The guide of claim 1 wherein said ramps have a configuration whereby one side of each said ramp is a slidable side and another side is a locking side.

4. The guide of claim 1 wherein said ramps have a triangular configuration.

5. The guide of claim 1 wherein said ramps are enabled to hold said corotron cartridge in position until said latch projection is removed from said groove by a cartridge handle.

6. The guide of claim 1 wherein said groove has dimensions that will allow said latch to move therein and be held in position.

7. A corona package structure comprising in an operative arrangement a corona cartridge and a cartridge protection guide, said cartridge comprising at its lower portion a release latch and a release latch handle, said handle enabled to move said latch when said handle is activated, said guide comprising a substantially modified L-shaped casing or housing and enabled to house substantially said entire corona cartridge, a locking feature positioned in an inner floor portion of said guide and comprising at least two upwardly protruding ramps, said ramps having a groove there between, said groove adapted to mate with said latch and lock said latch and said cartridge in position, wherein said cartridge is attached to said corona protection guide by being moved in a substantially longitudinal direction of said corona protection guide.

8. The structure of claim 7 whereby said ramp(s) have a configuration whereby one side of said ramp(s) is a slidable side.

9. The structure of claim 7 whereby said groove has dimensions suitable to allow said latch to fit therein.

10. The guide of claim 7 wherein said ramps are positioned to abut said latch when said corotron cartridge is enclosed in said guide.

11. The guide of claim 7 wherein one side of said ramps has a locking side configuration.

12. The guide of claim 7 wherein said ramps are enabled to hold said corotron cartridge in position until said latch projection is removed from said groove.

13. A corona and corona enclosure structure comprising in an operative arrangement a corona cartridge and a cartridge protection guide, said cartridge comprising at its lower outer portion a release latch and a latch release handle, said handle enabled to move said latch when said handle is activated, said handle extending outwardly from a terminal end of said cartridge and operatively connected to said latch, said guide comprising a substantially modified L-shaped housing and enabled to contain substantially an entire corona cartridge, a locking feature positioned in an inner floor portion of said guide and comprising at least two upwardly protruding ramps, said ramps having a slidable side, a locking side and a groove there between, said groove adapted to mate with said latch and lock said latch and said cartridge in position in said guide, wherein said cartridge is attached to said corona protection guide by being moved in a substantially longitudinal direction of said corona protection guide.

14. The structure of claim 13 whereby said ramps have a configuration whereby one side of each said ramp is a straight side forming a right angle with the horizontal.

15. The structure of claim 13 whereby said groove has dimensions suitable to allow said latch to fit and lock therein.

* * * * *